United States Patent [19]

Wischusen, III

[11] Patent Number: 4,754,914

[45] Date of Patent: Jul. 5, 1988

[54] PACKAGE FOR WRAPPING FOOD OR OTHER ARTICLES

[75] Inventor: Henry Wischusen, III, Lilburn, Ga.

[73] Assignee: Rock-Tenn Company, Norcross, Ga.

[21] Appl. No.: 913,121

[22] Filed: Sep. 26, 1986

[51] Int. Cl.[4] ..... B65D 65/00

[52] U.S. Cl. ..... 229/87 F; 229/40; 229/DIG. 13; 220/403

[58] Field of Search ..... 229/87 R, 87 F, 87 B, 229/40, 29 R, DIG. 13; 220/403

[56] References Cited

U.S. PATENT DOCUMENTS

| | | | |
|---|---|---|---|
| 948,524 | 2/1910 | Reid | 229/904 |
| 1,704,175 | 3/1929 | Coale | 99/171 R |
| 2,011,179 | 8/1935 | Krout | 383/117 |
| 2,556,321 | 6/1951 | Denton | 229/87 R |
| 3,061,170 | 10/1962 | Baker | 383/121 |
| 3,129,848 | 4/1964 | Canno | 383/121 |
| 3,166,235 | 1/1965 | Schroeder | 229/52 |
| 3,261,538 | 7/1966 | Jones et al. | 229/87 F |
| 3,285,495 | 11/1966 | Colato | 206/217 |
| 3,627,541 | 12/1971 | Farquhar | 99/171 R |
| 3,964,669 | 6/1976 | Sontag et al. | 229/87 F |
| 4,277,506 | 7/1981 | Austin | 220/403 |
| 4,558,815 | 12/1985 | Wischusen, III | 229/1.5 B |
| 4,575,000 | 3/1986 | Gordon et al. | 229/87 F |

OTHER PUBLICATIONS

Muffin Tin Liner (specimen).

*Primary Examiner*—Willis Little

*Attorney, Agent, or Firm*—Jones, Askew & Lunsford

[57] ABSTRACT

A composite package for enclosing articles such as fast food items, having a paperboard base and a flexible liner, preferably of treated tissue paper, laminated to the base. The liner provides the sole support for the side panels of the base in their erected configuration, and also provides the top closure of the package and a handle without paperboard support. In one embodiment, the liner is creased and pre-formed to form a stackable configurable which automatically guides itself into the proper erected position. In another embodiment, opposite side panels and attached liner are folded onto the central portion of the package and glued to form an intermediate flat form that is suitable for shipping and storage, and is easily erected for loading and closure.

31 Claims, 5 Drawing Sheets

Fig. 2
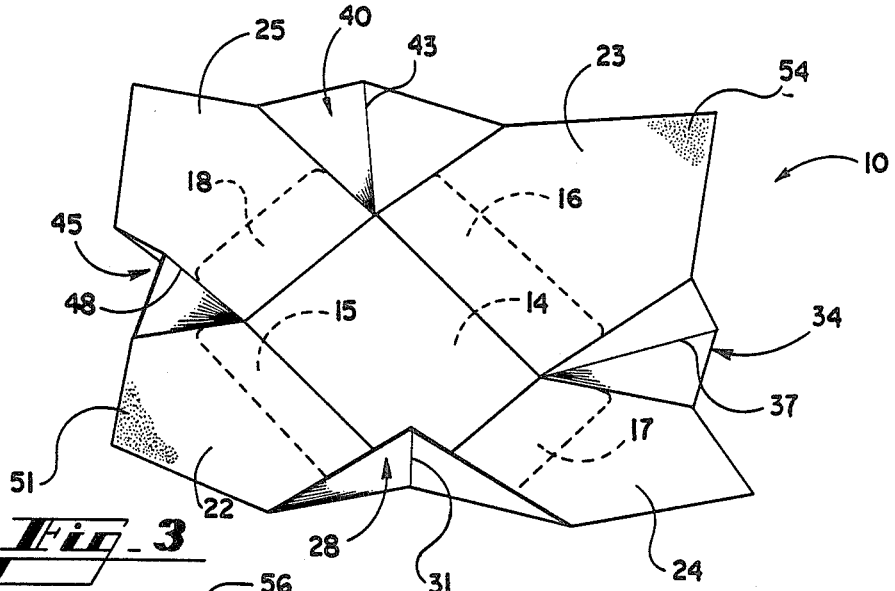
Fig. 3
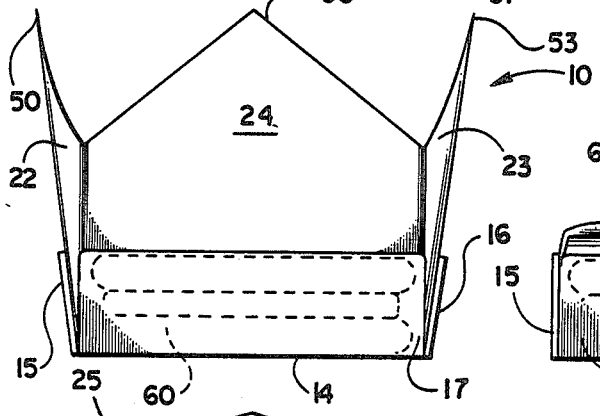
Fig. 6
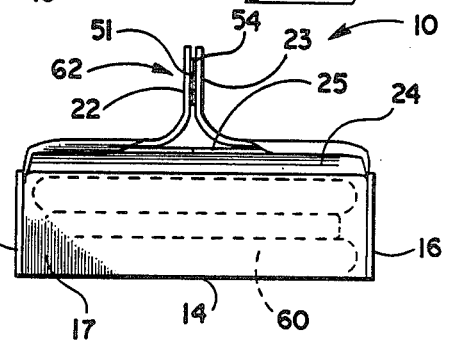
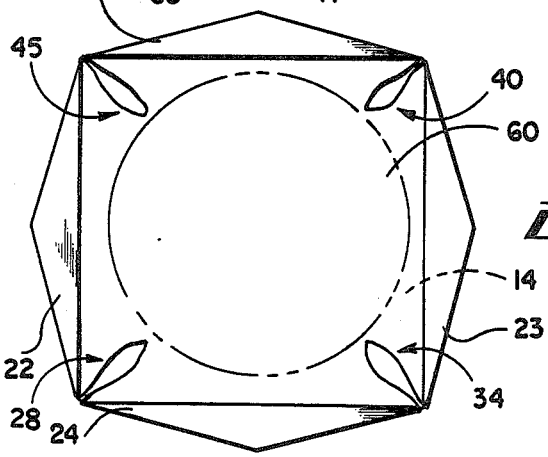
Fig. 4

PACKAGE FOR WRAPPING FOOD OR OTHER ARTICLES

TECHNICAL FIELD

The present invention relates to packaging materials made of paper, paperboard, and the like, and more particularly relates to a composite package in which a flexible liner is laminated to a relatively rigid base.

BACKGROUND ART

In the fast food industry, developing an ideal package for sandwiches, french fries, and the like, poses special problems. It is desirable to protect the product, but the package must be inexpensive. The package should occupy as little room as possible when shipped and stored awaiting use. It should be easy to use without much training or skill, and not awkward to close about the product. In many situations it is very advantageous if the package can be used as a surface on which to assemble a product such as a sandwich. The package should retain heat, but allow some venting of moisture to prevent sogginess of buns or french fries.

Conventional package designs for the fast food industry usually provide only one or two of the desirable features listed above. Simple wax paper wrapping sheets for sandwiches, for instance, provide an assembly surface and retain heat to some extent, but also retain moisture. They provide almost no protection against crushing the product.

Molded foam or paperboard boxes for sandwiches are relatively expensive because they enclose the entire article in rigid material, and they take up considerable space in the restaurant while awaiting use. Although paperboard boxes may be shipped flat, significant effort and time must be expended to pre-assemble the boxes prior to use. Boxes, furthermore, do not provide convenient surfaces for assembling sandwiches. An extra motion is therefore required to load the sandwich into the box. A lock of some sort is usually provided, and may be awkward to engage, or subject to breaking apart.

Open top french fry containers or bags provide considerable ventilation, but do not retain heat to keep the food warm between cooking and consumption.

Some attempts have been made to combine flexible wrapping materials, which have cost and space-saving characteristics, with paperboard sleeves to help protect sandwiches. These attempts have been less than successful. U.S. Pat. No. 3,964,669 discloses a central rigid member which is folded to surround the sandwich with a rigid sleeve and provide a paperboard handle. An outer flexible sheet attached to the rigid member extends beyond the open ends of the sleeve and must be tucked in or twisted to close the package in an unstable, unreliable fashion. Furthermore, awkward panels formed in the paperboard must be lifted and held back in order to place the sandwich in its proper position. U.S. Pat. No. 4,575,000 discloses an inner layer of glassine type paper and an outer layer of paperboard, again forming a rigid sleeve around the sandwich being wrapped. The extending glassine paper ends of the sleeve must be tucked under the sandwich, so that no positively fastened closure is provided. In the case of both of these patented packages, the flexible layer is provided flat and without preforming to assist the user in forming and closing the package. The tucking required to complete the package may result in crushing the contents. Furthermore, the principle is followed that the paperboard portion must surround the sandwich and form the top closure over the sandwich. Other lined containers are disclosed in U.S. Pat. Nos. 1,704,175; 2,011,179; 2,556,321 and 3,627,541.

Thus, a need exists in the art for a package for food having the desirable features listed above, which uses a small amount of paperboard efficiently to protect the food, which in effect guides the user in assembling the package, and which provides a positive closure and handle without complex paperboard structures.

SUMMARY OF THE INVENTION

The present invention solves problems in the art outlined above by providing a composite package having a paperboard base which does not extend over the contents, and a flexible liner which is preformed for ease of assembly and can be joined above the product without crushing the product to provide a positive closure and a handle for lifting the package.

Generally described, the present invention provides a package comprising a base of paperboard or the like, including a bottom panel and a plurality of side panels extending upwardly from the bottom panel; a flexible liner sheet laminated to the interior of the base, including a plurality of gusset portions connecting the side panels of the base and a plurality of cover portions extending outwardly from each of the side panels; and means for joining at least two of the cover portions to form a means for closing the package above the base.

The package is preferably erectable from an open configuration to an erected configuration, and the means for joining the cover portions of the liner sheet preferably form the sole means for maintaining the package in its erected configuration, and also provide a means for grasping the package. The gusset portions of the liner sheet are preferably pre-formed inwardly between adjacent side panels such that in the open form of the package the side panels, gusset portions, and cover portions are inclined upwardly with respect to the bottom panel. Several means for joining the cover portions can be utilized, such as cohesive applied to facing surfaces, mechanical crimping, peel-away tape or staples.

In another embodiment, the invention generally provides a package in a form convenient for storage and subsequent erection and loading, comprising a base of paperboard or the like, including a bottom panel and a pair of side panels extending from a first pair of opposite edges of the bottom panel; a flexible liner sheet laminated to the interior of the base and including a pair of cover portions extending outwardly from a second pair of opposite edges of the bottom panel, the cover portions each including a central area and a pair of side peripheral areas extending from the side panels on either side of the central area; the pair of side panels being folded inwardly onto the interior of the bottom panel, and the side peripheral areas being folded inwardly onto the central areas of the cover portions; and means for adhering the side peripheral areas to the central areas. Means can be provided for selectively joining the cover portions together over the bottom panel so as to hold the side panels in an erect position and cover an article within the package.

In order to more fully enclose the base, the side peripheral areas preferably overlap one another when folded inwardly. To permit the package to be opened easily for loading, weakening lines can be provided in the side peripheral areas extending from the corner intersections of the side panels with the second edges of the bottom panel diagonally to edges of the side peripheral areas. Preferably, the side peripheral areas are adhered to the central area only adjacent to an edge of the central area farthest from the base. To provided side panels on all sides of the contents of the package, a second pair of side panels can be provided extending outwardly from the second pair of opposite edges of the bottom panel.

The invention also provides a composite blank for forming a package, comprising a cross-shaped base of paperboard or the like, including a bottom panel and a plurality of side panels extending outwardly from the bottom panel; and a flexible liner sheet laminated to the base, and extending outwardly beyond each of the side panels.

A package according to the present invention thus protects its contents with upstanding side walls and a bottom made of paperboard, without the expense of the paperboard top or top locking mechanism. The preformed configuration of the initial embodiment permits nesting of the packages when shipped and stored awaiting use, which is conservative of space, but also makes the package very easy to form up around the contents, after using the package as a tray or surface for assembling a sandwich. An article that does not require assembly is easier to load when the package is in its preformed, open configuration. The wrapping of the flexible liner over the contents retains heat, but does not completely seal, so that venting of moisture can occur. The joining of the cover portions of the flexible liner provide a handle as well as a positive closure not likely to come undone as in prior art tuck-in closures.

The present invention also provides a partially erected blank for forming a three-dimensional package, comprising a sheet of material having a degree of deadfold characteristic; the sheet being pre-formed generally inwardly from a flat blank into a partially erected shape, such that the sheet can be nested with other such sheets, and such that under further inward pressure upon the periphery of the sheet, the sheet tends to assume a predetermined fully erect configuration.

Thus, it is an object of the present invention to provide an improved package suitable for articles such as heated food products and the like.

It is a further object of the present invention to provide a package which uses composite materials efficiently to save expense while providing product protection and ease of use.

It is a further object of the present invention to provide a package which nests to save space in shipment and storage.

It is a further object of the present invention to provide a package which guides a user in forming the package around a product.

It is a further object of the present invention to provide a package which retains heat while venting moisture.

It is a further object of the present invention to provide a package which assembles to form a handle without complex paperboard top panels or interlocking structures.

It is a further object of the present invention to provide a package having wrapped flexible sheet portions that are secured against accidental unwrapping.

Other objects, features, and advantages of the present invention will become apparent upon reading the following detailed description of embodiments of the invention, when taken in conjunction with the accompanying drawing and the appended claims.

BRIEF DESCRIPTION OF THE DRAWING

FIG. 2 is a pictorial view of a pre-formed configuration of a package embodying the invention.

FIG. 3 is a side plan view of the package of FIG. 2 in an erected, but not closed, configuration.

FIG. 4 is a top plan view of the package shown in FIG. 3.

FIG. 6 is a side plan view of the package of FIG. 5.

DETAILED DESCRIPTION

Figure 1:
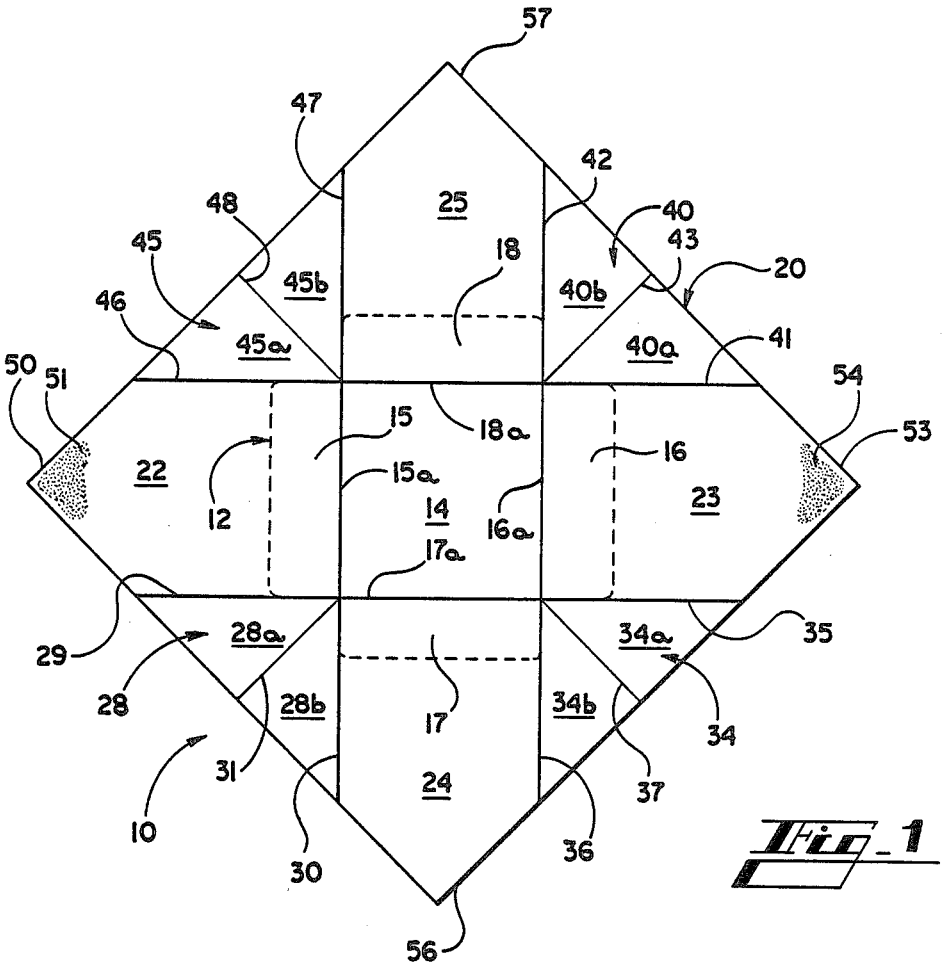
FIG. 1 is a top plan view of a blank for forming a package embodying the present invention.

Referring now in more detail to the drawing, FIG. 1 shows a top view of a package 10 embodying the invention in its initial un-erected configuration, that is, a flat composite blank. An erected package embodying the invention can be assembled from the blank 10 in a manner described below.

The blank 10 includes a base 12 constructed of paperboard or a similar, relatively rigid material that can be scored and folded. The base 12 is shown in dotted lines in FIG. 1 under a flexible liner sheet 20 which is laminated to the base 12 by means of an adhesive. Alternately, the base 12 and liner 20 can be heated sealed together if made from or coated with appropriate materials. The base consists of a central bottom panel 14 and four side panels 15, 16, 17 and 18 connected to edges of the bottom panel 14 along scores or fold lines 15*a*, 16*a*, 17*a* and 18*a*, respectively. The bottom panel is preferably square when the package is to be used for fast food sandwiches, and the side panels are preferably rectangular in shape and extend along an entire side of the square bottom panel, as shown. It will be understood, however, that the base can be formed having a bottom panel in other rectangular or non-rectangular shapes with appropriately shaped side panels, without departing from the present invention. For example, the bottom panel could be round, with a cylindrical or frusto-conical side wall attached thereto.

The flexible liner sheet 20 is preferably a square centered on the base 12 with its diagonal axes rotated 45 degrees with respect to the diagonal axes of the base 12. The liner 20 may be one of a wide variety of flexible materials depending upon the intended contents of the package. A tissue or other type of paper may be used, treated or untreated to prevent passage of water or grease. Alternately, a metal foil, plastic film, paper/-plastic laminate or paper/foil laminate could be used.

The liner can be limp or have a degree of rigidity, so long as it is sufficiently flexible to be folded together above the bottom panel as described below. In the preferred embodiment, the liner 20 is formed from a tissue paper coated with an appropriate treatement such as wax or polyethylene to render it impervious to water and grease, and to assist in giving it sufficient rigidity to tend to hold a shape when creased. Alternately, tissue paper can be treated with fluorocarbons to render it impermeable to grease but permeable to moisture.

In its diagonal relation to the base 12, the liner 20 provides cover portions 22, 23, 24 and 25 extending outwardly from the side panels 15, 16, 17 and 18, respectively, and gusset portions generally designated as 28, 34, 40 and 45, which connect the adjacent side panels together by spanning the space between the adjacent side panels. These regions of the liner 20 are preferably more specifically defined by creases or weakening lines formed in the material of the liner 20.

Thus, the gusset portion 28 is bounded by a crease 29 colinear with the score 17*a*, between the gusset portion 28 and the cover portion 22. The gusset portion 28 is also bounded by a crease 30 colinear with the score 15*a*, between the gusset portion 28 and the cover portion 24. The gusset portion 28 is also divided by a crease 31 which extends outwardly from the corner of the bottom panel formed by the intersection of the scores 15*a* and 17*a*.

As shown is FIG. 2, the creases 29, 30 and 31 are formed so that the gusset portion 28 is pre-formed to extend toward the interior of the package, with the dividing crease 31 projecting farthest inward.

Similarly the gusset portion 34 is bounded by a crease 35 colinear with the score 17*a*, between the gusset portion 34 and the cover portion 23. The gusset portion 34 is also bounded by a crease 36 colinear with the score 16*a*, between the gusset portion 34 and the cover portion 24. The gusset portion 34 is also divided by a crease 37 which extends outwardly from the corner of the bottom panel formed by the intersection of the scores 16*a* and 17*a*.

As shown is FIG. 2, the creases 35, 36 and 37 are formed so that the gusset portion 34 extends toward the interior of the package, with the dividing crease 37 projecting farthest inward.

Similarly, the gusset portion 40 is bounded by a crease 41 colinear with the score 18*a*, between the gusset portion 40 and the cover portion 23. The gusset portion 40 is also bounded by a crease 42 colinear with the score 16*a*, between the gusset portion 40 and the cover portion 25. The gusset portion 40 is also divided by a crease 43 which extends outwardly from the corner of the bottom panel formed by the intersection of the scores 16*a* and 18*a*.

As shown is FIG. 2, the creases 41, 42 and 43 are formed so that the gusset portion 40 extends toward the interior of the package, with the dividing crease 43 projecting farthest inward.

Similarly, the gusset portion 45 is bounded by a crease 46 colinear with the score 18*a*, between the gusset portion 45 and the cover portion 22. The gusset portion 45 is also bounded by a crease 47 colinear with the score 15*a*, between the gusset portion 45 and the cover portion 25. The gusset portion 45 is also divided by a crease 48 which extends outwardly from the corner of the bottom panel formed by the intersection of the scores 15*a* and 18*a*.

As shown is FIG. 2, the creases 46, 47 and 48 are formed so that the gusset portion 45 extends toward the interior of the package, with the dividing crease 48 projecting farthest inward.

All of the creases and scores are partially pre-folded as shown in FIG. 2, so that the blank 10 assumes a pre-formed, partially erect configuration. The inward extension of the gusset portions of the liner 20 cause the side panels 15–18 of the base 12 and attached cover portions 22–25 to incline upwardly from the horizontal bottom panel 14. In the configuration shown in FIG. 2, the packages can be easily formed upwardly to enclose a food item or other article placed on the bottom panel, because the gusset portions of the liner 20 automatically fold into the package when upward pressure is applied to the side panels or cover portions of the liner. Furthermore, packages as shown in FIG. 2 can be nested together in stacks for shipping and storage, and therefore occupy less space than erected containers. The preformed configuration also is sufficiently open that assembly of a sandwich or the like can be done directly on the portion of the liner which is attached to the bottom panel.

As a result of the diagonal alignment of the liner 20 with respect to the base 12, the cover portions 22–25 of liner extend outwardly to define pointed ends 50, 53, 56 and 57, respectively. Adjacent to the pointed end 53, the cover portion 22 is coated with a pressure-sensitive cohesive of the type that can also be separated by applying force. The cover portion 23 is also coated with the same cohesive adjacent to the pointed end 54.

In order to use the package 10, one of the partially erected packages as shown in FIG. 2 is taken off a nested stack of such packages, and an item, such as a sandwich 60, is placed in the center of the package on the portion of the liner 20 attached to the bottom panel 14. It will be understood that the package can be used as a surface on which to assemble the sandwich 60. When the package is fully loaded, the user lifts the cover portions 22–25 and attached side panels 15–18 upwardly into a configuration shown in FIGS. 3 and 4. The side panels now form vertical side walls which protect the sandwich against accidental crushing. The gusset portions 28, 34, 40 and 45 automatically fold into the interior of the package because of the manner in which they have been pre-creased. Their flexibility prevents them from crushing or interfering with the sandwich.

Figure 5:
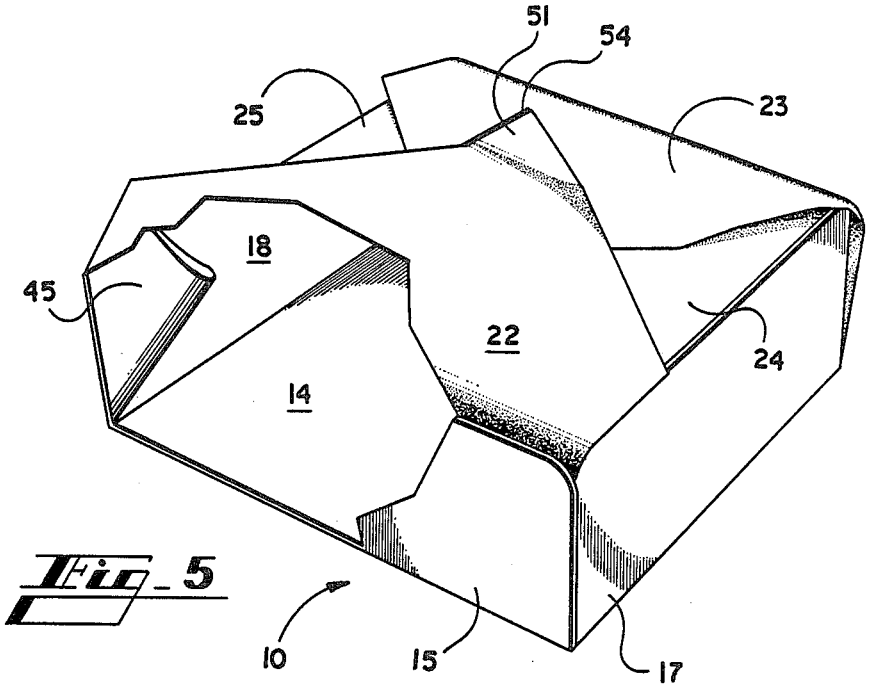
FIG. 5 is a pictorial view of the package of FIGS. 2–4, in a closed configuration, with portions cut away to show interior detail.

Next, the cover portions 24 and 25 are folded inwardly over the sandwich, and the cover portions 22 and 23 are brought together to engage the cohesive areas 53 and 54 over the center of the package, as shown in FIGS. 5 and 6. The pointed ends 50 and 53 form a handle that can be grasped to carry the package or lift it out of a paper bag or box. The ends can alternately be joined by other fastening means such as, but not limited to, mechanical crimping, peel-away tape or staples. The pressure of the joined cover portions 22 and 23 retains the cover portions 24 and 25 in place in a manner which closes the interior of the package sufficiently to retain heat, but allows some venting of moisture. Furthermore, the side panels 15–18 are held in their upright position solely by the material of the liner 20. It will thus be seen that the entire top closure of the package 10, the handle formed on the top closure, and the structural support for the side panels, are all provided by the flexible material rather than by the paperboard, unlike prior art composite packages.

The pre-forming of the package 10 as in FIG. 2 is highly advantageous. Loading and closure of the package 10 may thereby be accomplished without requiring awkward manipulation of the side panels and cover portions. No fixture or jig of the type shown in U.S. Pat. No. 3,627,541 is needed to allow a person to form the package around a product.

The concept of pre-forming the package 10 from the flat configuration shown in FIG. 1 to the partially erected configuration shown in FIG. 2 has application in non-lined packages as well as in lined packages of the type discussed above. Many three-dimensional packages are formed from flat blanks. If the sheet material from which the package is made has a degree of dead-fold characteristic, that is, the ability to retain a shape when formed, it can be pre-formed in accordance with the present invention. Pre-forming such a blank toward its fully erect position can thus result in the blank retaining a shape which is a partially erected configuration. In such a configuration, the periphery of the blank has been moved inwardly with respect to the center of the blank, as shown in FIG. 2. A very important characteristic of such a pre-formed blank is that the sheet of material tends to assume the intended fully erect configuration of the package upon further inward pressure upon the periphery of the sheet, thereby relieving the person assembling the package of the need to carefully assure that the package is being properly formed from a flat blank. Also, the pre-formed, partially erected blanks can be nested together for efficient storage.

For example, the package shown in FIG. 2 could be pre-formed even if only the liner 20 was present without the paperboard base 12, so long as the liner has a degree of dead-fold characteristic. In such an example, the liner would define a bottom panel, a plurality of side panels foldably connected to the bottom panel, the side panels being pre-formed upwardly and inwardly from the bottom panel to form an angle between the side panels and the bottom panel between 90 degrees and 180 degrees, and a plurality of gussets connecting the side panels together.

Figures 7, 8, 9:
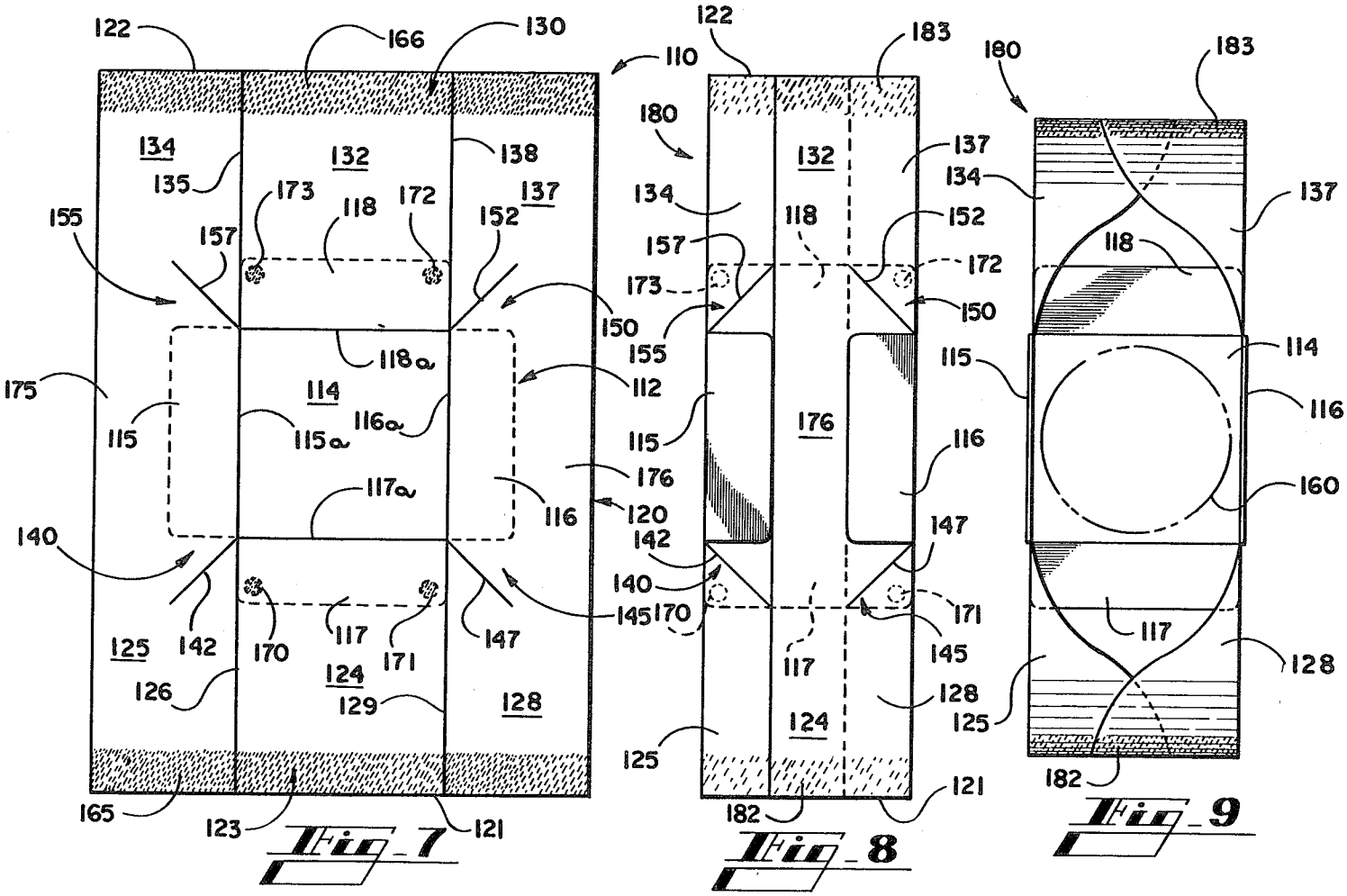
FIG. 7 is a top plan view of a blank for forming a second embodiment of the package of the present invention.
FIG. 8 is a top plan view of a pre-assembled package formed from the blank of FIG. 7 in a collapsed configuration.
FIG. 9 is a top plan view of the package of FIG. 8, in a partially erected configuration, opened for loading.

A second embodiment of a package 110 according to the present invention is shown in FIG. 7, which shows the package 110 in its unerected configuration, a flat composite blank. The blank 110 includes a base 112 constructed of paperboard or a similar, relatively rigid material that can be scored and folded. The base 112 is shown in dotted lines in FIG. 7 under a flexible liner sheet 120 which is laminated to the base 112 by means of an adhesive. The base consists of a central bottom panel 114 and four side panels 115, 116, 117 and 118 connected to edges of the bottom panel 114 along scores or fold lines 115*a*, 116*a*, 117*a*, and 118*a*, respectively. The bottom panel again is preferably square when the package is to be used for fast food sandwiches, and the side panels are preferably rectangular in shape and extend along an entire side of the square bottom panel, as shown. It should be noted that the side panels 117 and 118 can be omitted in order to further minimize the use of paperboard.

The flexible liner sheet 120 consists of a material as noted above in connection with the first embodiment. The liner 120 is, however, preferably rectangular and is aligned over the base such that the two opposite shorter edges of the liner sheet, 121 and 122, are parallel to the edges of the bottom panel 114 formed by the scores 117*a* and 118*a*. The liner 120 provides cover portions generally designated as 123 and 130 extending outwardly from the side panels 117 and 118, respectively. The cover portion 123 defines a central area 124 aligned with the side panel 117, and two side peripheral areas 125 and 128, separated from the central area 124 by creases 126 and 129, respectively. The crease 126 is colinear with the score 115*a*, and the crease 129 is colinear with the score 116*a*.

The cover portion 130 defines a central area 132 aligned with the side panel 118, and two side peripheral areas 134 and 137, separated from the central area 132 by creases 135 and 138, respectively. The crease 135 is colinear with the score 115*a*, and the crease 138 is colinear with the score 116*a*.

The liner 120 also includes gusset portions generally designated as 140, 145, 150 and 155. Such gusset portions are the portions of the liner 120 spanning the space between the adjacent side panels of the base 112. Each gusset portion is preferably divided by a crease 142, 147, 152 and 157, respectively, extending outwardly from a respective corner of the bottom panel 114. The creases dividing the gusset portions can extend to the edge of the liner sheet 120, or can terminate even with the periphery of the base 112 as shown.

Adhesive is applied to the blank 110 as shown in FIG. 7 to hold the package in its intermediate form shown in FIG. 8. A strip of adhesive 165 is applied to the liner sheet 120 adjacent to its edge 121. The adhesive strip 165 can extend along the entire edge 121 as shown, or along a portion thereof so as to attach the side peripheral areas 125 and 128 to the central area 124 as described below. A similar adhesive strip is applied along the opposite edge 122 of the liner 120.

Adhesive spots are applied to the liner 120 over the side panels 117 and 118 to facilitate the performance of the diagonal creases 142, 147, 152 and 157. Thus, a spot 170 is applied to the corner of the side panel 117 near the crease 142, a spot 171 is applied to the corner of the panel 117 near the crease 147, a spot 172 is applied to the corner of the panel 118 near the crease 152, and a spot is applied to the corner of the panel 118 near the crease 157. It should be understood that the package 110 can be erected and perform adequately without the diagonal creases and associated glue spots, but that erection is facilitated by such creases and glue spots, as described below.

In the preferred form of the package 110, the side peripheral areas of the cover portions 123 and 130 extend beyond the outer edges of the side panels 115 and 116, and are joined by cover portions 175 and 176 of the liner sheet 120, which are aligned with the side panels 115 and 116, respectively. These additional cover portions assist in enclosing an article loaded into the package, but may be omitted without departing from the invention. In the latter case, the liner sheet would have a width equal to the width of the base across the side panels 115 and 116 and the bottom panel 114.

FIG. 8 shows a top plan view of an intermediate form 180 of the package convenient for shipping and storage prior to use. To assemble the package into the intermediate form 180, the blank 110 is folded along score 116*a* and creases 138 and 129 to fold the side panel 116 and side peripheral areas 128 and 137 onto the central part of the blank. Adhesive strips 165 and 166 retain the folded parts in place lying flat on the bottom panel 114 and central areas 124 and 132 of the liner sheet. Adhesive spots 171 and 172 engage the folded gusset portions, so that the liner sheet is adhered to itself at the edges 121 and 122 and at the gusset portions 145 and 150.

Next, the blank is folded along the score 115*a* and the creases 126 and 135 to fold the side panel 115 and side peripheral areas 125 and 134 onto the central part of the blank 110. The liner sheet adheres to itself at the adhesive strips 165 and 166, and at the spots 170 and 173. If the width of the liner sheet 120 extends beyond the side panels 115 and 116, as shown in FIG. 7, the side peripheral areas and the cover portions 175 and 176 overlap. However, they are not adhered to one another except at the edges 121 and 122 of the liner sheet 120.

Strips of cohesive 182 and 183 are applied along the upwardly facing portions of the liner sheet 120 along the edges 121 and 122, respectively. Such strips of cohesive may be applied before, during or after assembly of the package to the form 180 shown in FIG. 8.

Figure 10:
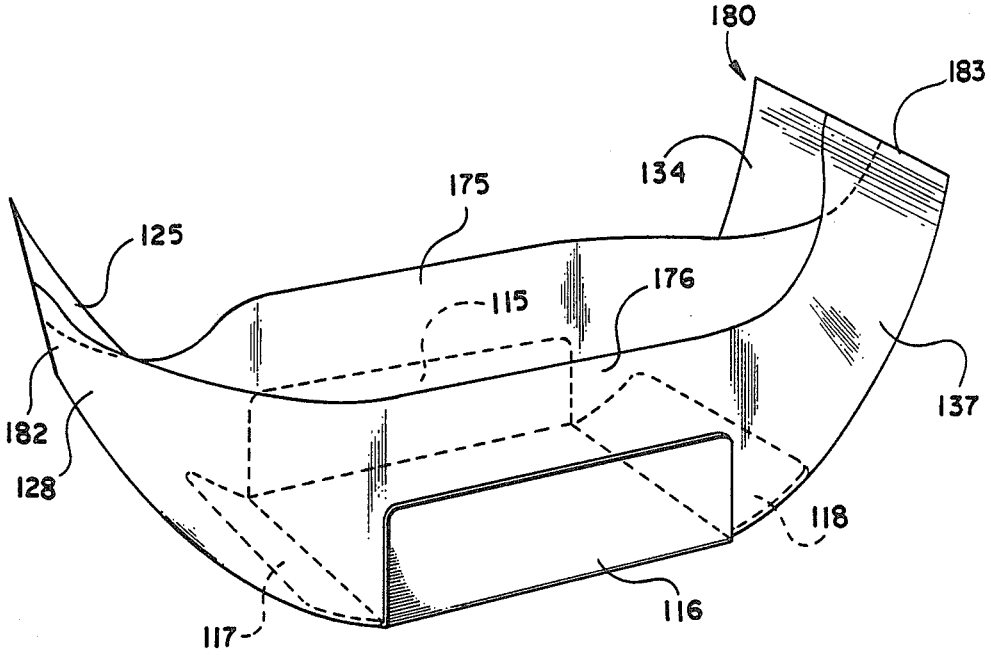
FIG. 10 is a pictorial view of the package of FIG. 9.

To load the package 180, the longitudinal edges of the liner sheet 120 are grasped at the center of the package and drawn upwardly and outwardly. This action causes the side panels 115 and 116 to become vertical, and automatically causes the side panels 117 and 118 to begin to rise. The resulting loading configuration is shown in FIGS. 9 and 10. If the gusset creases 142, 147, 152 and 157, and the glue spots 170–173 are present, the folding of the gusset portions is facilitated and bridging of the liner material at the gussets is prevented. Interaction of the longitudinal edges of the side peripheral areas 125 and 134 under the areas 128 and 137 will tend to keep the package open. To the extent this is not sufficient, the user can hold two adjacent side panels, such as 115 and 117, with one hand while loading a sandwich 160 or other article into the package with the other hand.

Figure 13:
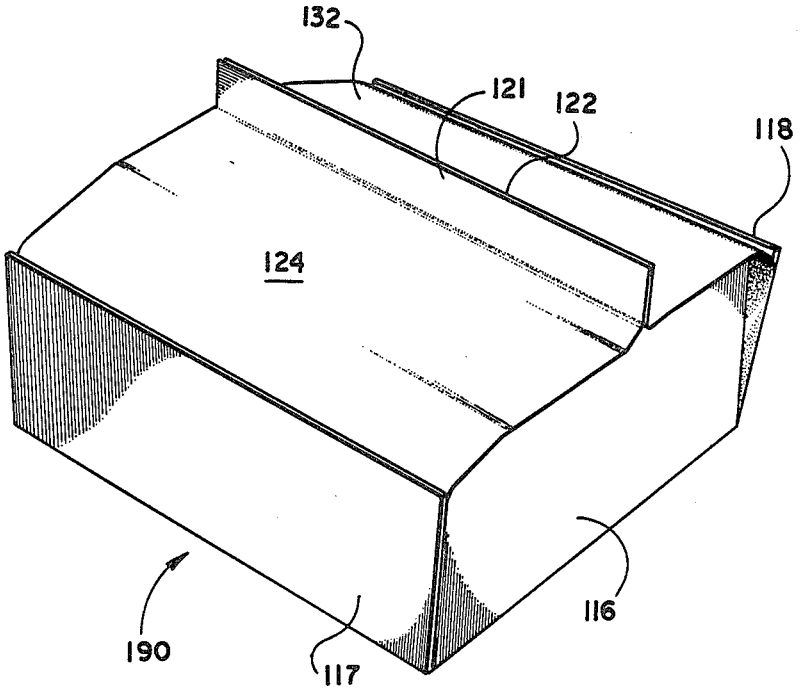
FIG. 13 is a pictorial view of the package of FIG. 12.
Figure 12:
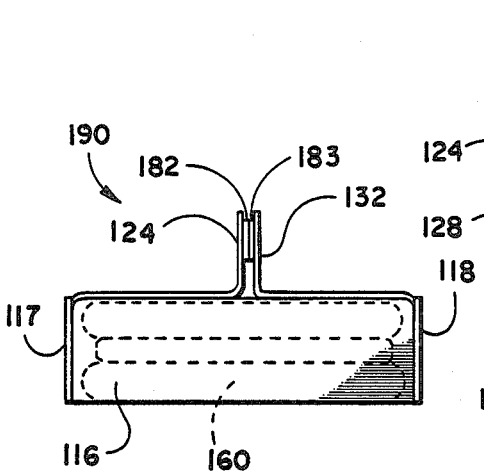
FIG. 12 is a side plan view of the package of FIGS. 8–10 in a closed configuration.
Figure 11:
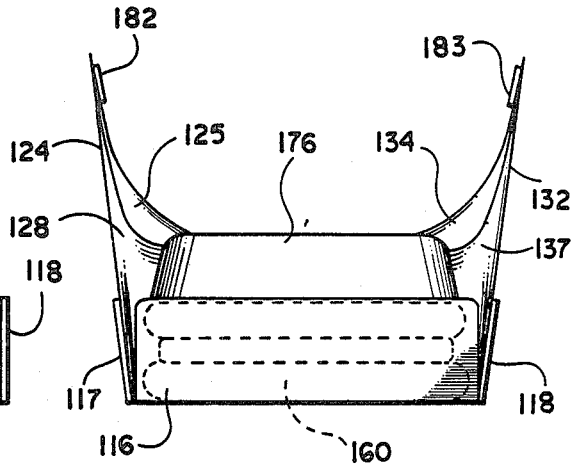
FIG. 11 is a side plan view of the package of FIGS. 8–10, in a fully erected, but not closed, configuration.

After loading of an article into the package, the package is brought first into an erect configuration, shown in FIG. 11, by raising the side panels 117 and 118 to a vertical position. Then the package is brought into a closed form 190 as shown in FIGS. 12 and 13 by folding the cover portions 175 and 176 (if present) over the article 160 and then bringing the cohesive strips 182 and 183 on the cover portions 123 and 130 into engagement. As was the case with the first embodiment of the invention described above, the flexible liner material supports the paperboard members in their erect positions, positively closes the package, and forms a handle member. Alternate means can be used to join the cover portions 123 and 130, as described above.

It should be noted that the adhesive connection between the side peripheral areas and central areas of the cover portions 123 and 130 can be confined to a position close to the edges 121 and 122 of the liner sheet, or can extend inwardly to a position near the side panels 117 and 118. However, with reference to FIG. 8, such adhesive connection must not be above the elements of the base 112.

It will thus be seen that the embodiment of FIGS. 7–13 also provides a package in which paperboard side walls are supported and the contents are enclosed by inexpensive flexible material. The advantages of the first embodiment of the invention are present, with the exception of the open pre-formed configuration being replaced by the intermediate form 180 of the second embodiment which is even easier to close about the contents of the package. It should be noted that the extent of venting allowed by the package can be controlled by adjusting the width of the cover panels 175 and 176.

While this invention has been described in detail with particular reference to preferred embodiments thereof, it will be understood that variations and modifications can be effected within the spirit and scope of the invention as described hereinbefore and as defined in the appended claims.

I claim:

1. A package, comprising:

a base comprising paperboard or the like, including a bottom panel and a plurality of side panels extending upwardly from said bottom panel;

a flexible liner sheet laminated to the interior of said base, including a plurality of gusset portions connecting the side panels of said base and a plurality of cover portions extending outwardly from each of said side panels; and means for joining at least two of said cover portions to close said package above said base.

2. The package of claim 1, wherein said package is erectable from an open configuration to an erected configuration, and wherein said means for joining said cover portions of said liner sheet forms the sole means for maintaining said package in its erected configuration.

3. The package of claim 1, wherein said gusset portions of said liner sheet are pre-formed inwardly between adjacent side panels such that in the open form of said package said side panels, gusset portions, and cover portions are inclined upwardly with respect to said bottom panel.

4. The package of claim 3, wherein said liner sheet comprises tissue paper.

5. The package of claim 3, wherein said liner sheet comprises moisture impermeable paper.

6. The package of claim 3, wherein said liner sheet comprises moisture permeable paper.

7. The package of claim 3, wherein said liner sheet comprises plastic film.

8. The package of claim 3, wherein said liner sheet comprises metal foil.

9. The package of claim 1, wherein said bottom panel and side panels are rectangular, and wherein four of said side panels extend outwardly from four edges of said bottom panel.

10. The package of claim 1, wherein said means for joining said cover portions forms said cover portions into a handle means above said package.

11. The package of claim 1, wherein said means for joining said cover portions comprises cohesive applied to facing surfaces of said joined cover portions.

12. The package of claim 1, wherein said means for joining said cover portions comprises crimped areas of said cover portions joining them together.

13. The package of claim 1, wherein said means for joining said cover portions comprises peelaway tape.

14. A package in a form convenient for storage and subsequent erection and loading, comprising:

a base comprising paperboard or the like, including a bottom panel, and a pair of side panels extending from a first pair of opposite edges of said bottom panel;

a flexible liner sheet laminated to the interior of said base, and including a pair of cover portions extending outwardly from a second pair of opposite edges of said bottom panel, said cover portions each including a central area and a pair of side peripheral areas extending from said side panels on either side of said central area;

said pair of side panels being folded inwardly onto the interior of said bottom panel, and said side peripheral areas being folded inwardly onto said central areas of said cover portions; and means for adhering said side peripheral areas to said central areas.

15. The package of claim 14, further comprising means for selectively joining said cover portions together over said bottom panel so as to hold said side panels in an erect position and cover an article within said package.

16. The package of claim 14, wherein said side peripheral areas overlap one another when folded inwardly.

17. The package of claim 14, further comprising weakening lines in said side peripheral areas extending from the corner intersections of said side panels with the second edges of said bottom panel diagonally to edges of said side peripheral areas.

18. The package of claim 14, wherein said pair of side panels comprises a first pair of side panels, and further comprising a second pair of side panels extending outwardly from said second pair of opposite edges of said bottom panel.

19. A package in a form convenient for storage and subsequent erection and loading, comprising:

a base comprising paperboard or the like, including a bottom panel, a first pair of side panels extending from a first pair of opposite edges of said bottom panel, and a second pair of side panels extending from a second pair of opposite edges of said bottom panel;

a flexible liner sheet laminated to the interior of said base, including a plurality of gusset portions connecting the side panels of said base, and a pair of cover portions extending outwardly from said second pair of side panels, said cover portions each including a central area and a pair of side peripheral areas extending outwardly from said gusset portions on either side of said central area;

said first pair of side panels being folded inwardly to a position parallel to said bottom panel, said gusset portions being folded inwardly onto said second pair of side panels, and said side peripheral areas being folded inwardly onto said central areas of said cover portions; and means for adhering said side peripheral areas to said central areas.

20. The package of claim 19, wherein said side peripheral areas overlap one another when folded inwardly.

21. The package of claim 19, further comprising weakening lines in said side peripheral areas extending from the corner intersections of said side panels with the second edges of said bottom panel diagonally through said gusset portions.

22. The package of claim 21, further comprising means for adhering said second pair of side panels to said gusset portions at a location on the side of said weakening line farthest from said first side panels.

23. The package of claim 19, further comprising means for selectively joining said cover portions together above said bottom panel to hold said package in an erected configuration.

24. The package of claim 19, wherein said side peripheral areas are adhered to said central area only adjacent to an edge of said central area farthest from said base.

25. A composite blank for forming a package, comprising:

a cross-shaped base comprising paperboard or the like, including a bottom panel and a plurality of side panels extending outwardly from said bottom panel; and a flexible liner sheet laminated to said base, and extending outwardly beyond each of said side panels.

26. A partially erected unused blank adapted to be manually loaded and formed up into a three-dimensional package enclosing an item, comprising:

a sheet of material having a degree of dead-fold characteristic, defining a bottom panel, a plurality of side panels foldably connected to said bottom panel, and a plurality of gussets connecting said side panels together;

said sheet being pre-formed generally upwardly and inwardly from a flat blank into a partially erected shape in which said side panels and said gussets each form an obtuse angle with said bottom panel;

such that said sheet can be nested with other said sheets; and such that said pre-formed sheet is capable of supporting itself in said partially erected shape during loading of said item, and under further inward pressure upon the periphery of said sheet, said sheet tends to assume a predetermined fully erect configuration for closure about said item.

27. A method of preparing a blank of a material having a degree of dead-fold characteristic for loading, comprising the steps of:

scoring said blank to define a bottom panel and a plurality of side panels foldably connected to said bottom panel; and pre-forming each of said side panels upwardly and inwardly to form an obtuse angle with said bottom panel, such that said blank assumes a self-supporting partially erected configuration readily formed up into a fully erected configuration.

28. A method of packaging an article in a package formed from a blank of a material having a degree of dead-fold characteristic, comprising the steps of:

scoring said blank to define a bottom panel and a plurality of said panels foldably connected to said bottom panel;

pre-forming each of said side panels upwardly and inwardly to form an obtuse angle with said bottom panel, such that said blank assumes a self-supporting partially erected configuration;

placing said article on said bottom panel within said partially erected blank; and urging said side panels inwardly to fully erect said package.

29. The method of claim 28, wherein said step of scoring said blank further includes defining a plurality of gusset panels connecting said side panels, and wherein said step of pre-forming each of said side panels further includes folding said gusset panels upwardly and inwardly with said side panels.

30. A nested stack of blanks of a material having a degree of dead-fold characteristic, each of said blanks comprising:

a sheet of said material scored to define a bottom panel and a plurality of side panels each foldably connected to said bottom panel and pre-formed upwardly and inwardly to form an obtuse angle with said bottom panel, such that each of said blanks assumes a partially erected configuration retained in said nest, said partially erected configuration being self-supporting when said blank is removed from said stack and being readily formed up into a fully erected configuration.

31. The composite blank of claim 25, wherein said flexible liner sheet extends between said side panels, and wherein said blank is pre-formed such that said side panels each form an obtuse angle with said bottom panel.

* * * * *